US011737555B2

(12) United States Patent
Lin et al.

(10) Patent No.: US 11,737,555 B2
(45) Date of Patent: Aug. 29, 2023

(54) ELECTRIC TABLE, LEG STAND AND LIGHTWEIGHT BEAM STRUCTURE THEREOF

(71) Applicant: TIMOTION TECHNOLOGY CO., LTD., New Taipei (TW)

(72) Inventors: Yu-Chang Lin, New Taipei (TW); Yu-Xiang Lin, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/685,355

(22) Filed: Mar. 2, 2022

(65) Prior Publication Data

US 2023/0210254 A1 Jul. 6, 2023

(30) Foreign Application Priority Data

Jan. 4, 2022 (TW) ..... 111100262

(51) Int. Cl.
*A47B 9/20* (2006.01)
*A47B 13/02* (2006.01)

(52) U.S. Cl.
CPC ..... *A47B 9/20* (2013.01); *A47B 13/02* (2013.01); *A47B 2200/0051* (2013.01); *A47B 2200/0056* (2013.01)

(58) Field of Classification Search
CPC ..... A47B 9/20; A47B 13/02; A47B 13/003; A47B 2200/0051; A47B 2200/0056
See application file for complete search history.

(56) References Cited

U.S. PATENT DOCUMENTS 11,490,726 B1 * 11/2022 Zhang ..... A47B 9/00
2014/0367538 A1 * 12/2014 Widholzer ..... A47B 9/20 248/188.1
2017/0224101 A1 * 8/2017 Bruder ..... A47B 13/06
(Continued)

FOREIGN PATENT DOCUMENTS

TW M486995 U 10/2014
TW M504506 U 7/2015
(Continued)

OTHER PUBLICATIONS

Office Action dated Oct. 17, 2022 of the corresponding Taiwan patent application No. 111100262.

*Primary Examiner* — Daniel J Rohrhoff
(74) *Attorney, Agent, or Firm* — Chun-Ming Shih; HDLS IPR SERVICES

(57) ABSTRACT

A lightweight beam structure includes a first and a second frame. The first frame includes an upper plate, two inner side plates downward bent and extended from two sides of the upper plate, two outer side plates upward bent and extended from two inner side plates respectively and two fixing plates bent and extended from two outer side plates respectively. Each outer side plate is formed outside each inner side plate. A groove is formed between each inner side plate and each outer side plate. The second frame is connected with the first frame and includes a top plate and two intermediate plates downward bent and extended from two sides of the top plate. Each intermediate plate is received in each groove. The top plate is formed over the upper plate. Therefore, the stability is maintained and the weight is reduced so that the material costs may be decreased.

16 Claims, 13 Drawing Sheets

(56) References Cited

U.S. PATENT DOCUMENTS

| | | | | |
|---|---|---|---|---|
| 2018/0064241 | A1* | 3/2018 | Tseng | A47B 9/10 |
| 2018/0110325 | A1* | 4/2018 | Oberndörfer | A47B 13/003 |
| 2019/0125072 | A1* | 5/2019 | Tseng | A47B 9/20 |
| 2020/0154876 | A1* | 5/2020 | Liu | A47B 9/00 |
| 2020/0359785 | A1* | 11/2020 | Lu | A47B 9/00 |
| 2021/0100355 | A1* | 4/2021 | Jørgensen | A47B 3/0809 |

FOREIGN PATENT DOCUMENTS

| | | |
|---|---|---|
| TW | M560241 U | 5/2018 |
| TW | M618980 U | 11/2021 |
| TW | M626132 U | 4/2022 |

* cited by examiner

ELECTRIC TABLE, LEG STAND AND LIGHTWEIGHT BEAM STRUCTURE THEREOF

BACKGROUND

Technical Field

The disclosure relates to an electric table, particularly to an electric table, a leg stand, and a lightweight beam structure thereof.

Related Art

According to different body types, body heights and users' habits, the tables of fixed types become obsolete. Electric lift tables with height adjustment have been the mainstream and the trend of modern designs. After adjusting the height, the tables can match users with different body heights and body types for comfort.

A related-art leg frame of an electric table includes a beam structure, a pair of telescopic posts and a pair of side wings. The beam structure is composed of two rectangular tubes connected at an interval and a receiving recess formed between the two rectangular tubes.

However, in order to make the leg frame possess considerable strength, connecting the rectangular tubes to constitute the beam structure not only requires complicated processes but also makes the finished leg frame have a heavy weight which is disadvantageous to being shifted and transported. Also, such a heavy weight makes the material costs unable to be effectively reduced to affect the economic profit.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

SUMMARY

An object of the disclosure is to provide an electric table, a leg stand, and a lightweight beam structure thereof, which use the shapes of the frames to keep the stability, reduce the weight and decrease the material costs.

To accomplish the above object, the disclosure provides an electric table, which includes a leg frame, a table plate and multiple screwing elements. The leg frame includes a lightweight beam structure, a pair of telescopic posts and a pair of side wings. The lightweight beam structure includes a first frame and a second frame. The first frame includes an upper plate, a pair of inner side plates separately downward bent and extended from two sides of the upper plate, an outer side plate upward bent and extended from each inner side plate and a fixing plate bent and extended from each outer side plate. Each outer side plate is formed outside each inner side plate. A groove is formed between each inner side plate and each outer side plate. The second frame is connected with the first frame and includes a top plate and a pair of intermediate plates separately downward bent and extended from two sides of the top plate. Each intermediate plate is received in each groove. The top plate is formed over the upper plate. The telescopic posts are separately connected to two ends of the lightweight beam structure. Each telescopic post includes an electric motor. Each side wing is separately disposed on a side of each telescopic post. The table plate has a bottom surface. Each screwing element passes through the first frame and the second frame to attach each fixing plate and the top plate on the bottom surface.

To accomplish the above object, the disclosure provides a leg frame of an electric table, which includes a lightweight beam structure, a pair of telescopic posts and a pair of side wings. The lightweight beam structure includes a first frame and a second frame. The first frame includes an upper plate, a pair of inner side plates separately downward bent and extended from two sides of the upper plate, an outer side plate upward bent and extended from each inner side plate and a fixing plate bent and extended from each outer side plate. Each outer side plate is formed outside each inner side plate. A groove is formed between each inner side plate and each outer side plate. The second frame is connected with the first frame and includes a top plate and a pair of intermediate plates separately downward bent and extended from two sides of the top plate. The intermediates plates are separately received in each groove. The top plate is formed over the upper plate. Each telescopic post is separately connected to two ends of the lightweight beam structure. Each telescopic post includes an electric motor. Each side wing is separately disposed on a side of each telescopic post.

To accomplish the above object, the disclosure provides a lightweight beam structure, which includes a first frame and a second frame. The first frame includes an upper plate, a pair of inner side plates separately downward bent and extended from two sides of the upper plate, an outer side plate upward bent and extended from each inner side plate and a fixing plate bent and extended from each outer side plate. Each outer side plate is formed outside each inner side plate. A groove is formed between each inner side plate and each outer side plate. The second frame is connected with the first frame and includes a top plate and a pair of intermediate plates separately downward bent extended from two sides of the top plate. The intermediate plates are separately received each groove. The top plate is formed over the upper plate.

The disclosure further has the following functions. By the co-planarity of each fixing plate, the top plate, the protrusion and the transverse plate of each side wing, and the rigidity of the table plate, the weight of the bean structure may be effectively reduced. By each intermediate plate being slidably connected to each groove, it may be widely applied for table plates with different lengths and specifications. By each telescopic post being pivotally connected to the beam structure, the time and labor costs in an installing scene may be saved.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
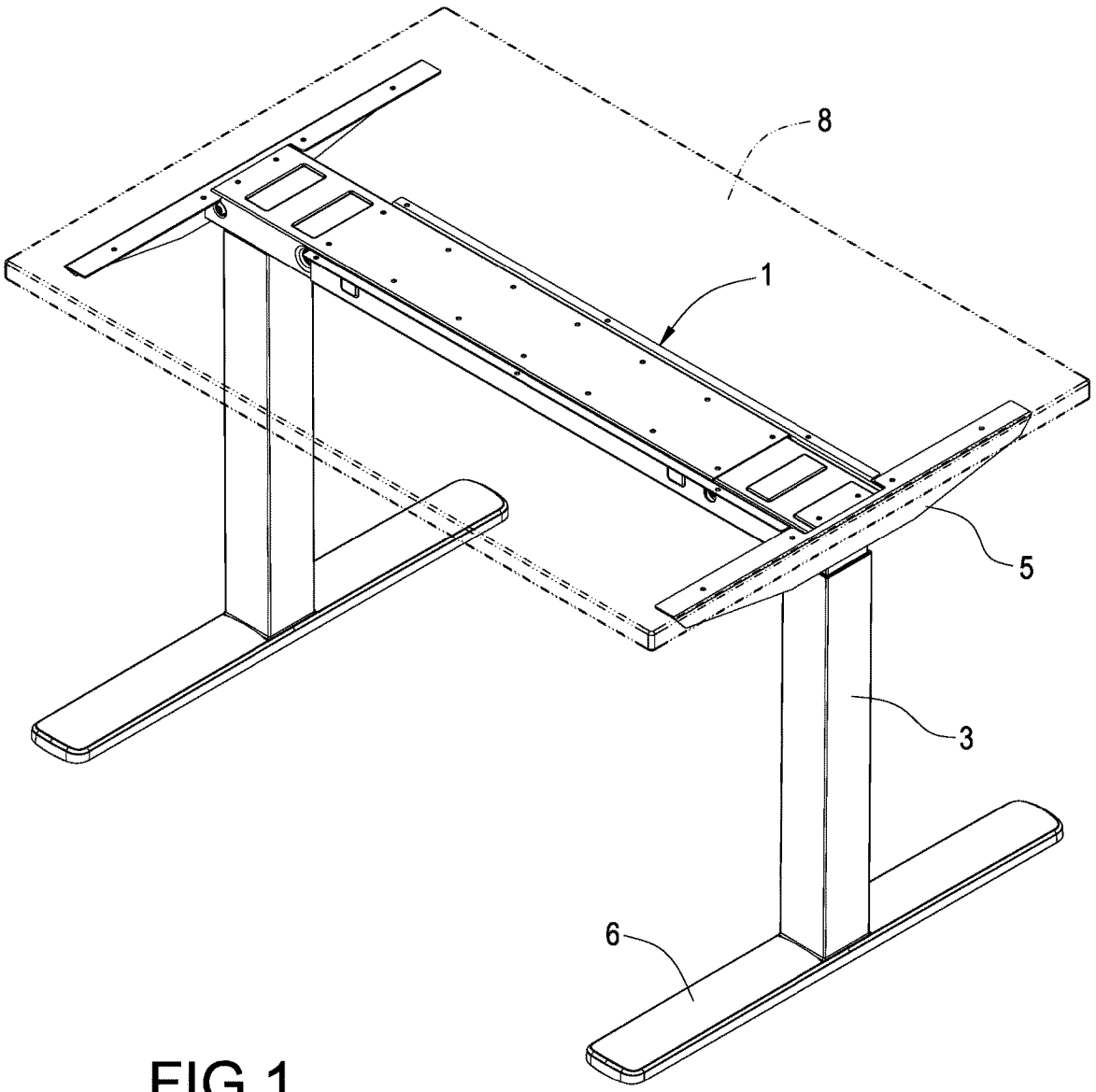
FIG. 1 is a schematic view of the leg frame of the disclosure associating with a table plate.
Figure 2:
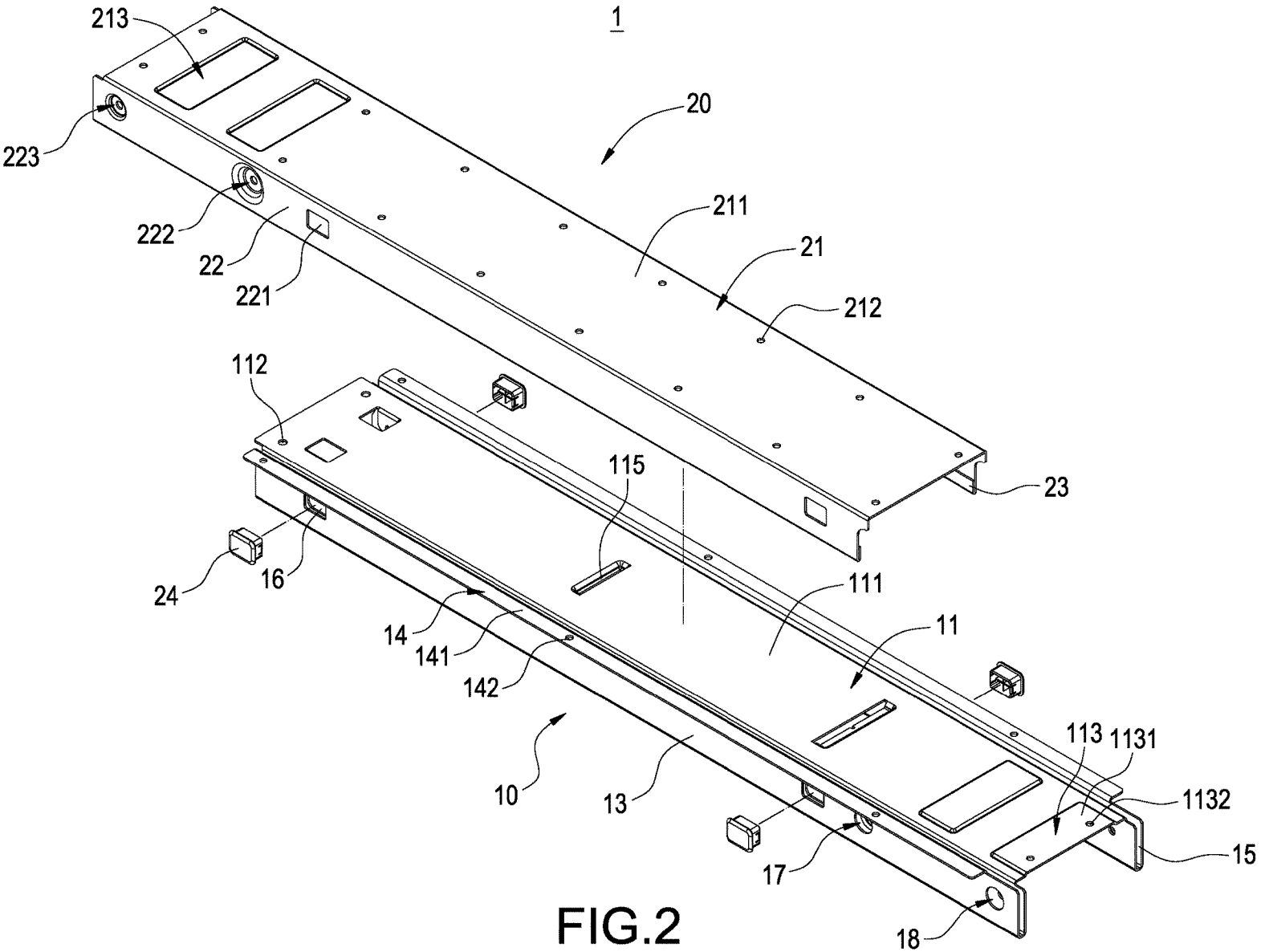
FIG. 2 is an exploded view of the lightweight beam structure of the disclosure.
Figure 3:
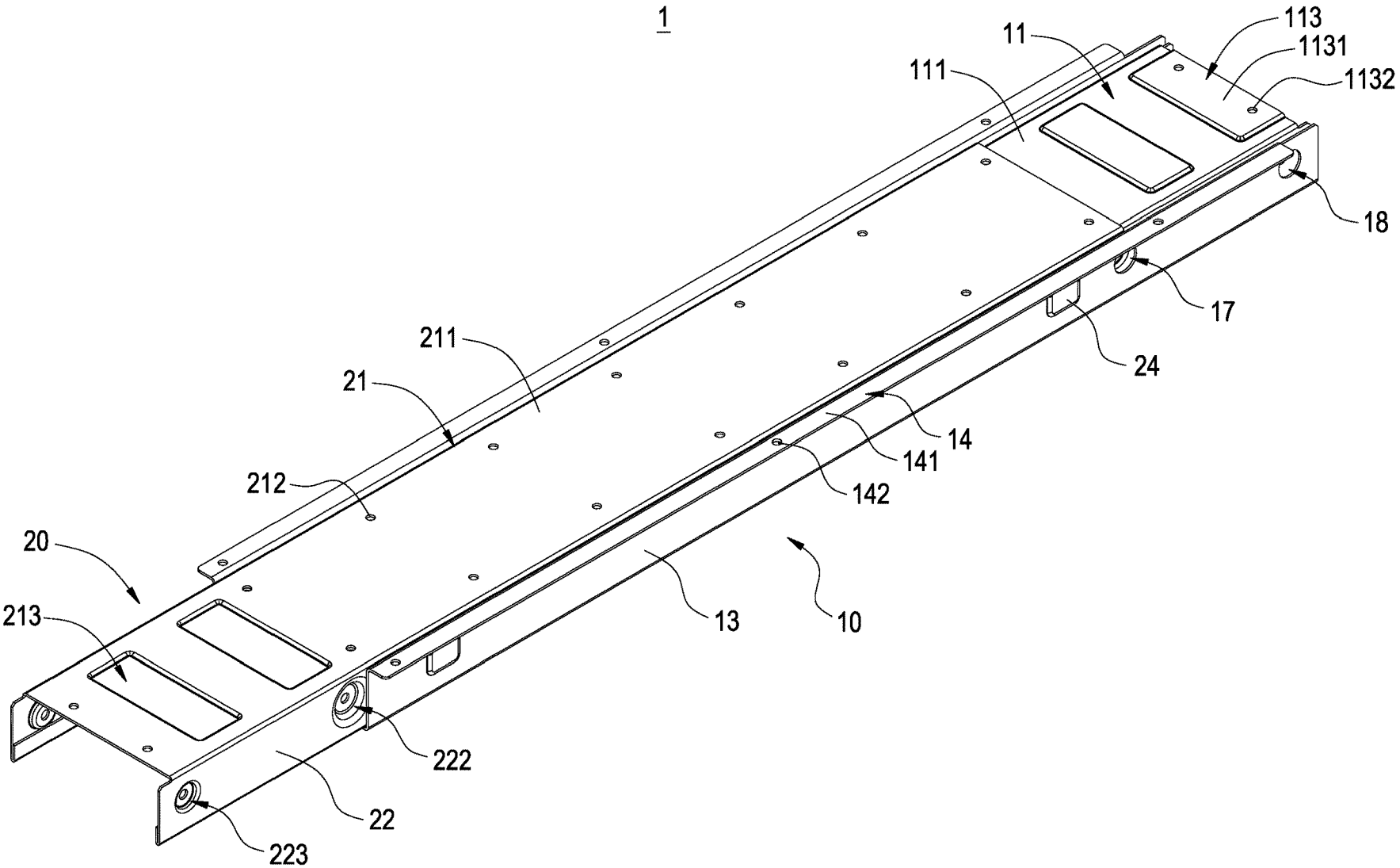
FIG. 3 is an assembled view of the lightweight beam structure of the disclosure.
Figure 4:
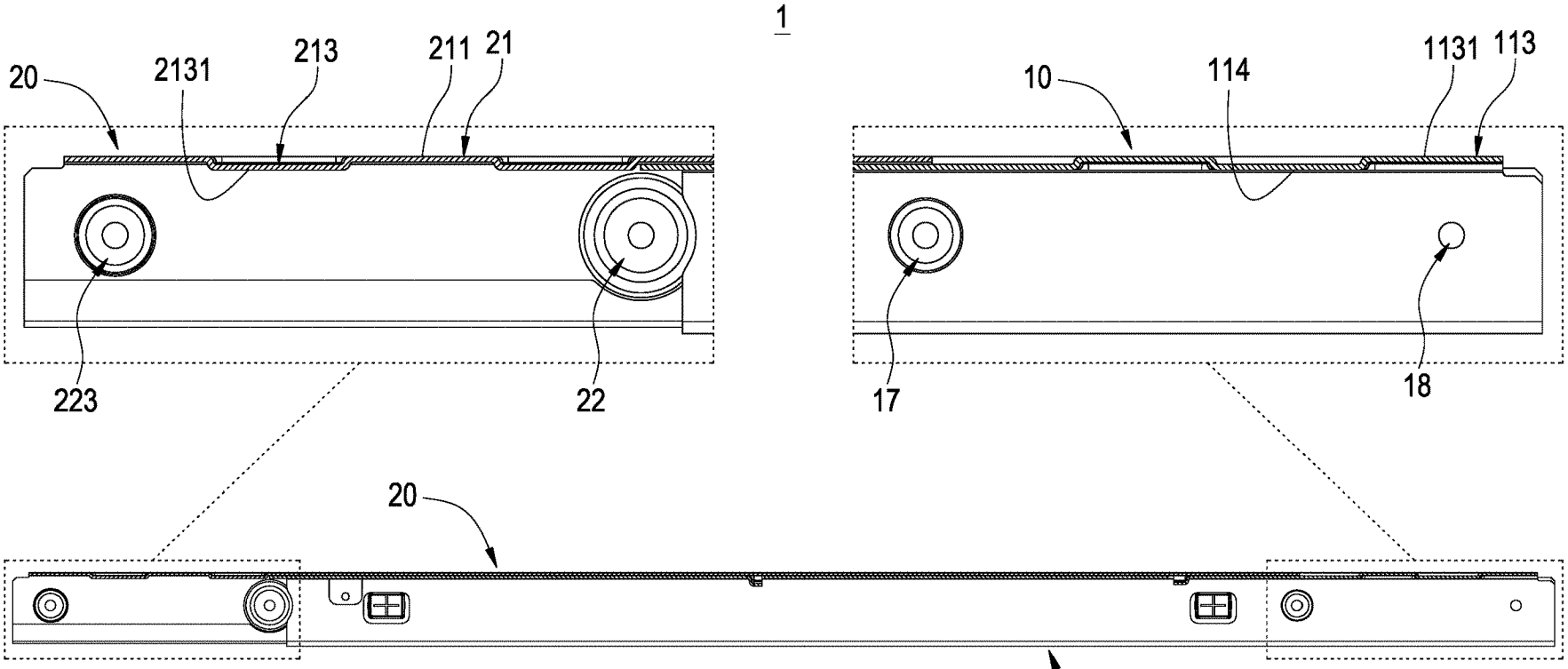
FIG. 4 is a cross-sectional view and a partially enlarged view of the lightweight beam structure of the disclosure.
Figure 5:
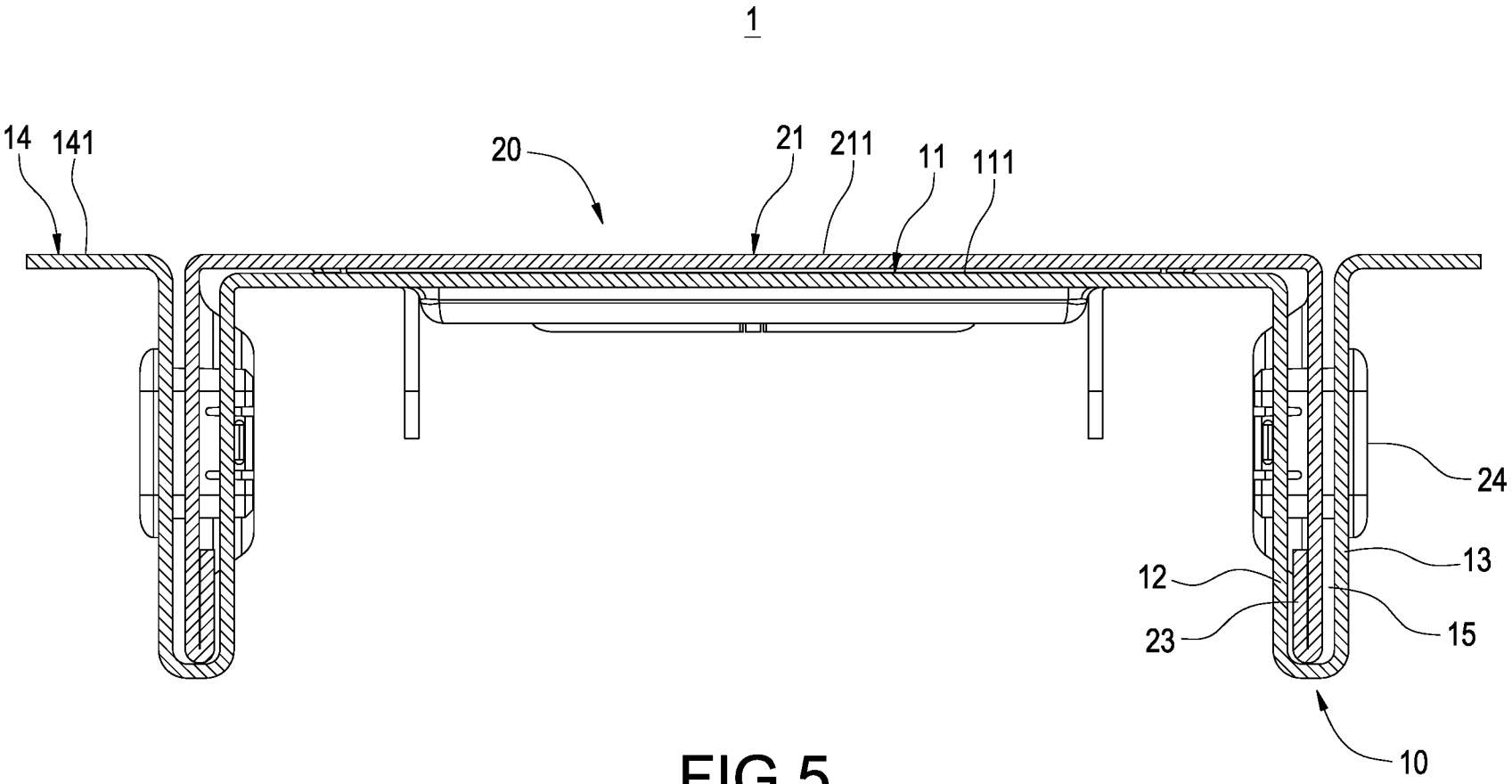
FIG. 5 is another cross-sectional view of the lightweight beam structure of the disclosure along another direction.
Figure 9:
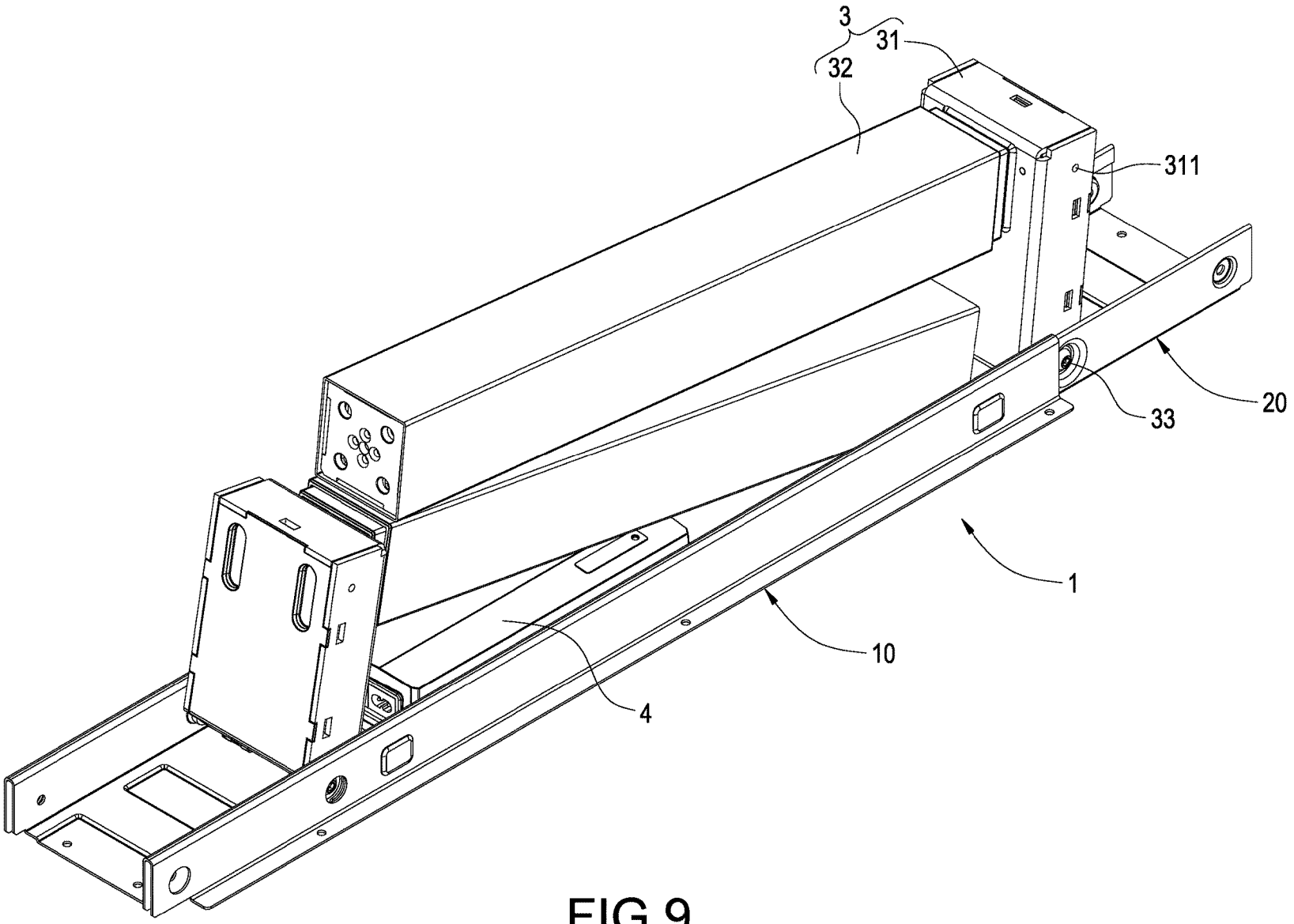
FIG. 9 is a schematic of pre-combination of the lightweight beam structure and the telescopic posts of the disclosure before being assembled.
Figure 10:
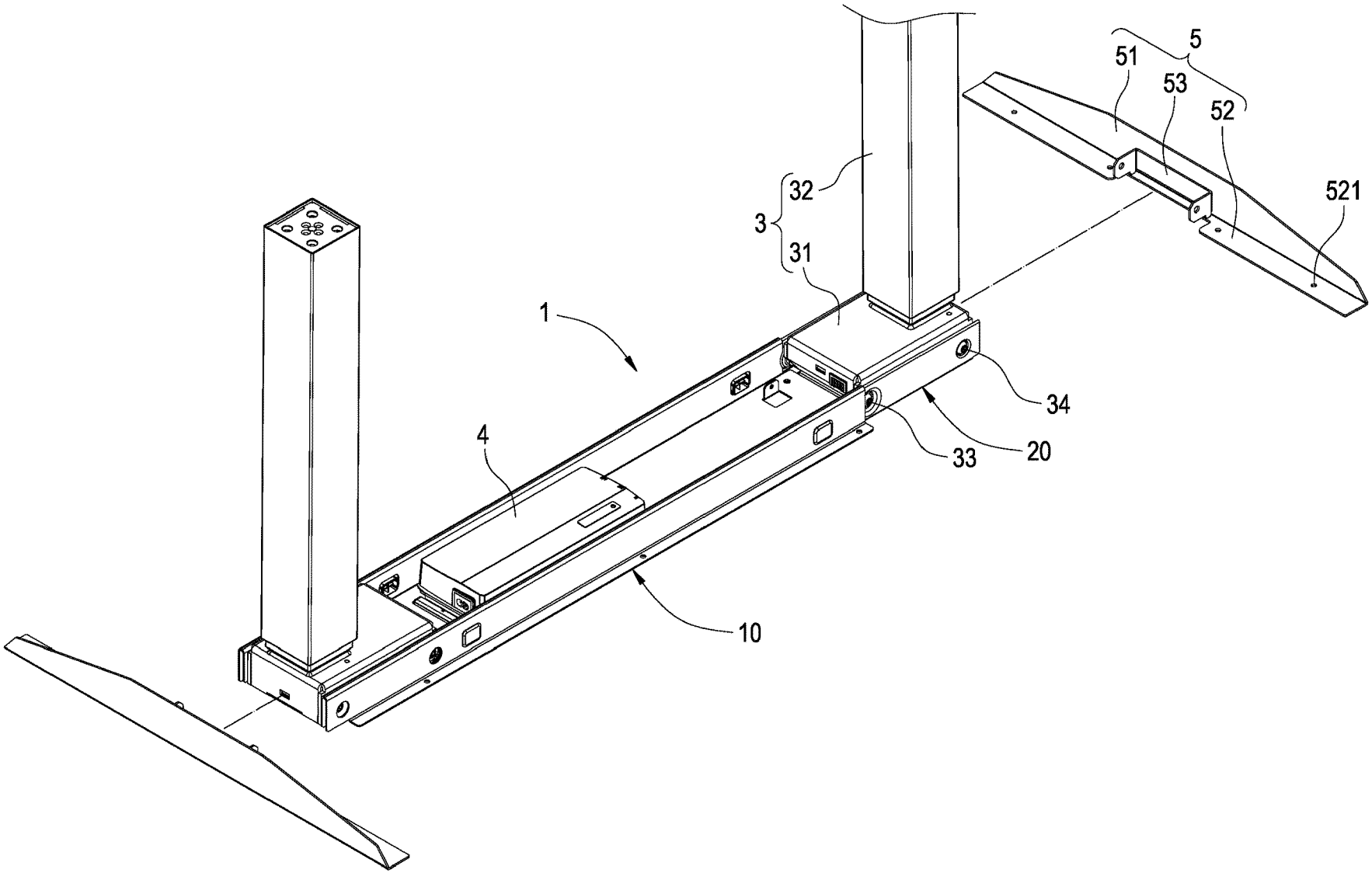
FIG. 10 is an exploded view of the leg frame of an electric table of the disclosure.

Please refer to FIGS. 1, 9 and 10. The disclosure provides a leg frame of an electric table for supporting a table plate 8. The leg frame includes a lightweight beam structure 1, a pair of telescopic post 3 and a pair of side wings 5. The telescopic posts 3 are pivotally connected to two ends of the lightweight beam structure 3 respectively. The side wings 5 are separately disposed on a side of each telescopic post 3 and connected to two ends of the lightweight beam structure 3.

Please refer to FIGS. 2-5. The disclosure further provides a lightweight beam structure 1, which includes a first frame 10 and a second frame 20.

The first frame 10 is made by the processes of punching, blanking, and bending a metal plate. The first frame 10 includes an upper plate 11, a pair of inner side plates 12, a pair of outer side plates 13 and a pair of fixing plates 14. The inner side plates 12 are separately downward bent and extended from a front side and a rear side of the upper plate 11. Each outer side plate 13 is upward bent and extended from each inner side plate 12. Each outer side plate 13 is parallel to each inner side plate 12. Each fixing plate 14 is bent and extended from each outer side plate 13 for being attached on the table plate 8.

Each outer side plate 13 is formed outside each inner side plate 12. A groove 15 is formed between each inner side plate 12 and each outer side plate 13. Each fixing plate 14 has an upper surface 141. The upper plate 11 also has an upper surface 111. The upper surfaces of the fixing plates 14 are on the same plane and on a plane higher than that of the upper surface 111 of the upper plate 11.

In an embodiment, a left area of the upper plate 11 is formed with an alignment hole 112, and a right area of the upper plate 11 is provided with two stages 113. Each stage 113 has an upper surface 1131. The upper surface 1131 of each stage 113 and the upper surface 141 of each fixing plate 14 are substantially on the same plane. In addition, the outer stage 113 is formed with two locking holes 1132.

In an embodiment, multiple plugging holes 16 are respectively formed on each inner side plate 12 and each outer side 13 corresponding to each other. Each plugging hole 16 penetrates each inner side plate 12 and each outer side plate 13. Right areas of each inner side plate 12 and each outer side plate 13 are separately provided with a pivoting portion 17 and a positioning portion 18. Please refer to FIG. 6. The pivoting portion 17 of the embodiment includes a protrusion 171 formed on an inner surface of the inner side plate 12 and a pivot hole 172 penetrating the protrusion 171 and the outer side plate 13. The positioning portion 18 of the embodiment is a positioning hole penetrating the inner side plate 12 and the outer side plate 13. In addition, each fixing plate 14 is formed with multiple locking holes 142 at intervals.

The second frame 20 is also made by the processes of punching, blanking, and bending a metal plate. The second frame 20 is connected with the first frame 10 and includes a top plate 21 and a pair of intermediate plates 22. The intermediate plates 22 are separately downward bent and extended from a front side and a rear side of the top plate 21. Each intermediate plate 22 is perpendicular to the top plate 21. Each intermediate plate 22 is received in each groove 15. The top plate 21 is formed over the upper plate 11.

In an embodiment, each intermediate plate 22 is slidably connected to each groove 15 and is located between each inner side plate 12 and each outer side plate 13. The top plate 21 has an upper surface 211. The upper surface 141 of each fixing plate 14, the upper surface 1131 of each stage 113 and the upper surface 211 of the top plate 21 are substantially on the same plane.

It is noted that the phrase "the upper surface 141 of each fixing plate 14, the upper surface 1131 of each stage 113 and the upper surface 211 of the top plate 21 are substantially on the same plane" means that the upper surface 141 of each fixing plate 14, the upper surface 1131 of each stage 113 and the upper surface 211 of the top plate 21 are jointly attached on the table plate 8.

Figure 13:
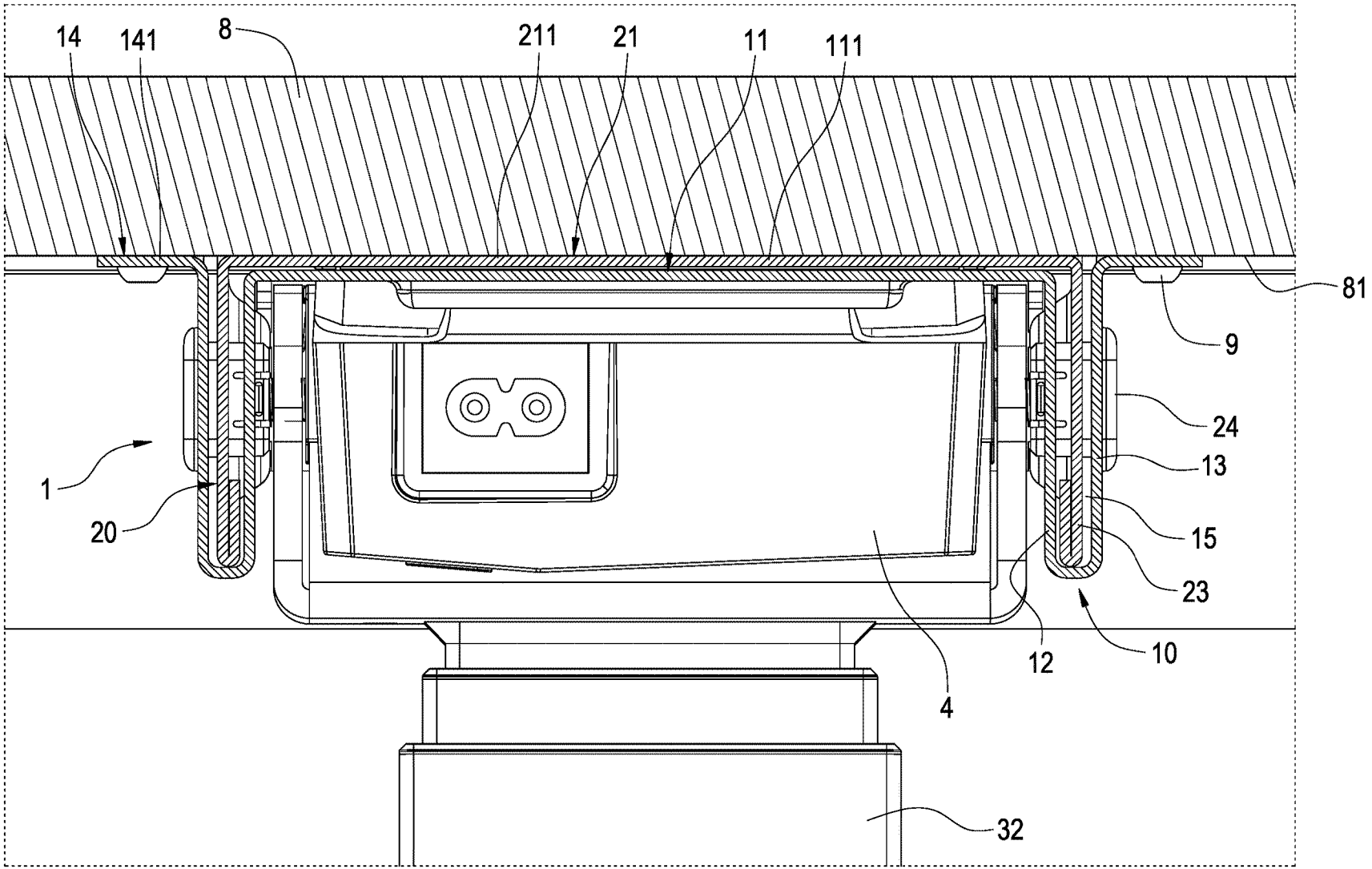
FIG. 13 is a cross-sectional view of the electric table of the disclosure along another direction.

In an embodiment, the top plate 21 is formed with multiple locking holes 212. Each locking hole 212 is arranged at regular intervals. The alignment hole 112 is selectively aligned with one of the locking holes 212 and a screwing element 9 is used to pass through the alignment hole 112 and the locking hole 212 for fixing as shown in FIG. 13. A left area of the top plate 21 is formed with two recess portions 213. Each recess portion 213 has a lower surface 2131. The upper plate 11 has a lower surface 114. The lower surface 2131 of each recess portion 213 and the lower surface 114 of the upper plate 11 are substantially on the same plane.

In an embodiment, an end of each intermediate plate 22, which is away from the top plate 21, is extended with a back-folded plate 23 between the intermediate plate 22 and the inner side plate 12. Each intermediate plate 22 is formed with multiple plugging holes 221. The plugging hole 221 of each intermediate plate 22 and the plugging hole 16 may be passed by a plug 24 for fixing when they are aligned with each other.

Figure 6:
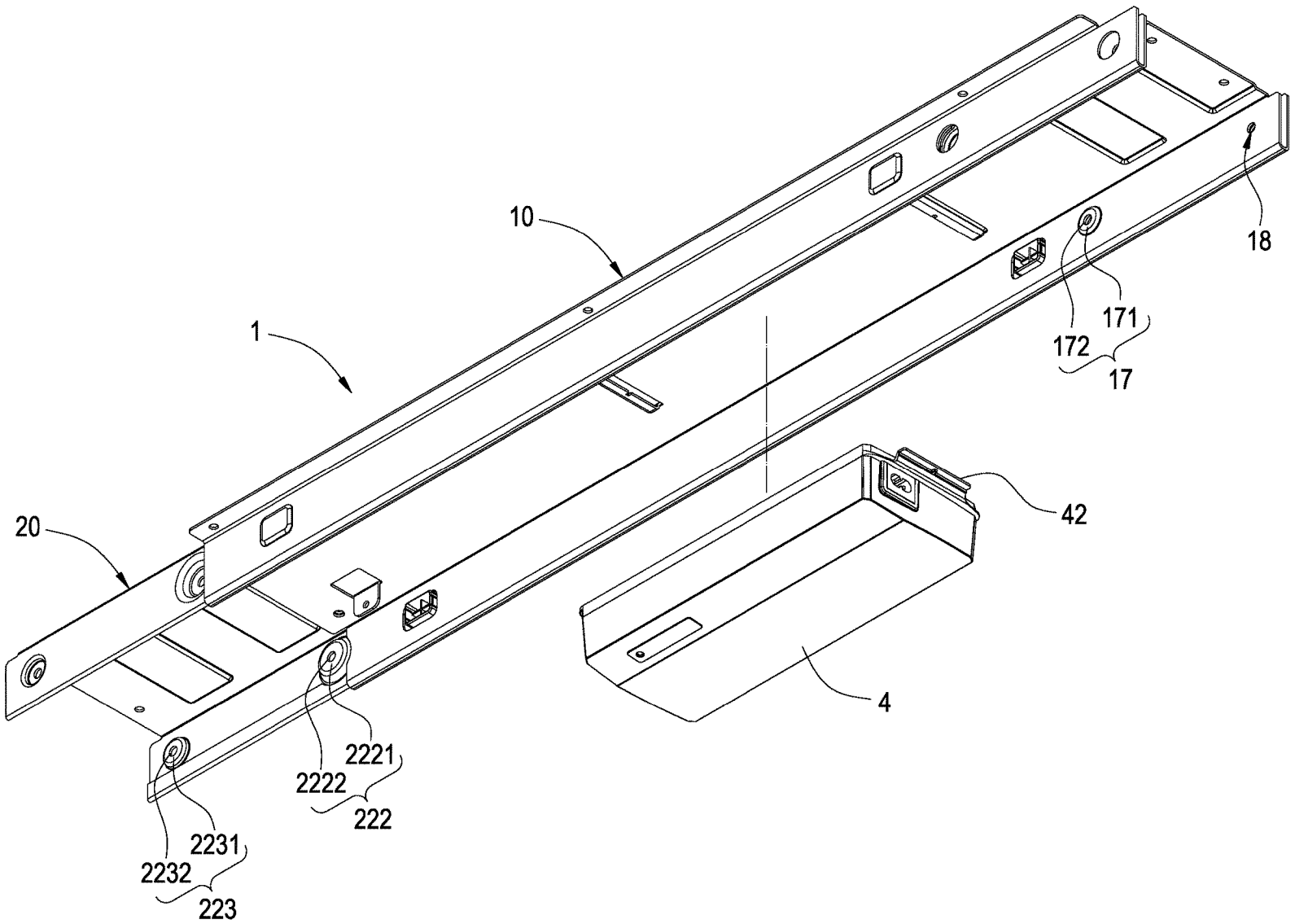
FIG. 6 is an exploded view of the lightweight beam structure and the controller of the disclosure.

Please refer to FIG. 6. Left area of each intermediate plate 22 is provided with a pivoting portion 222 and a positioning portion 223. The pivoting portion 222 of the embodiment includes a protrusion 2221 formed on an inner surface of the intermediate plate 22 and a pivot hole 2222 penetrating the protrusion 2221. The positioning portion 223 of the embodiment also includes a protrusion 2231 formed on an inner surface of the intermediate plate 22 and a positioning hole 2232 penetrating the protrusion 2231.

Figure 7:
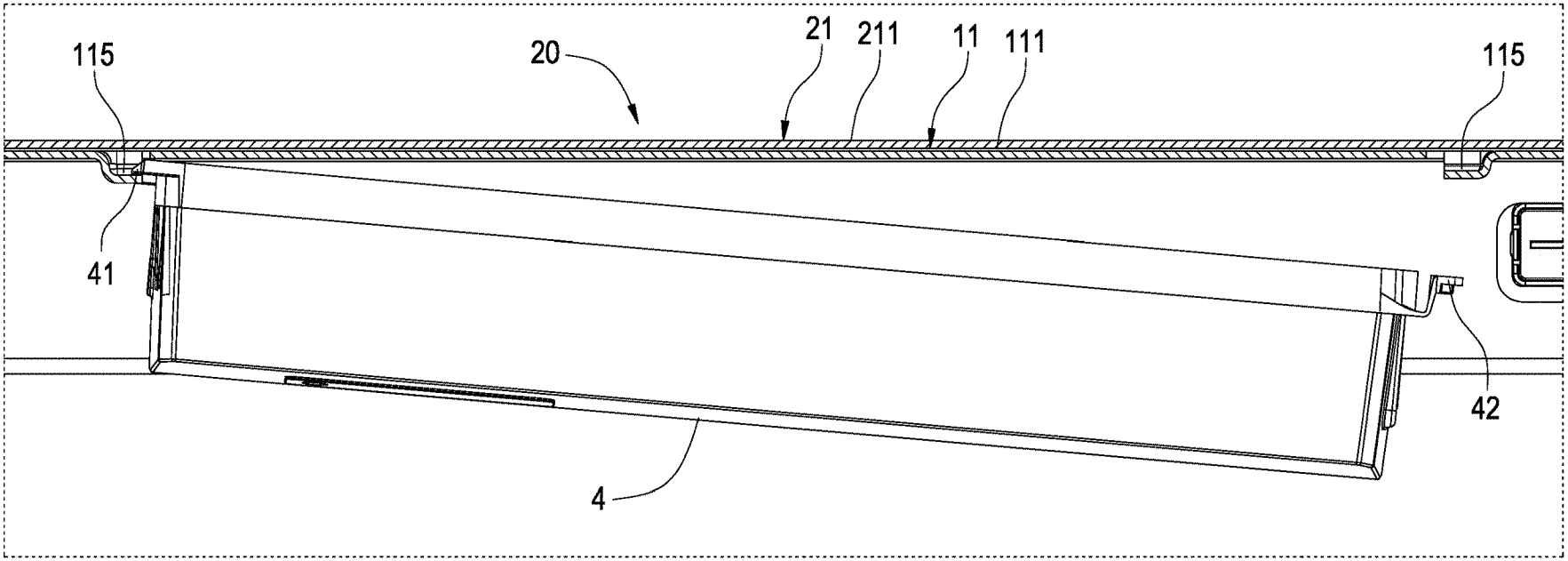
FIG. 7 is a cross-sectional view of the lightweight beam structure and the controller of the disclosure before being assembled.
Figure 8:
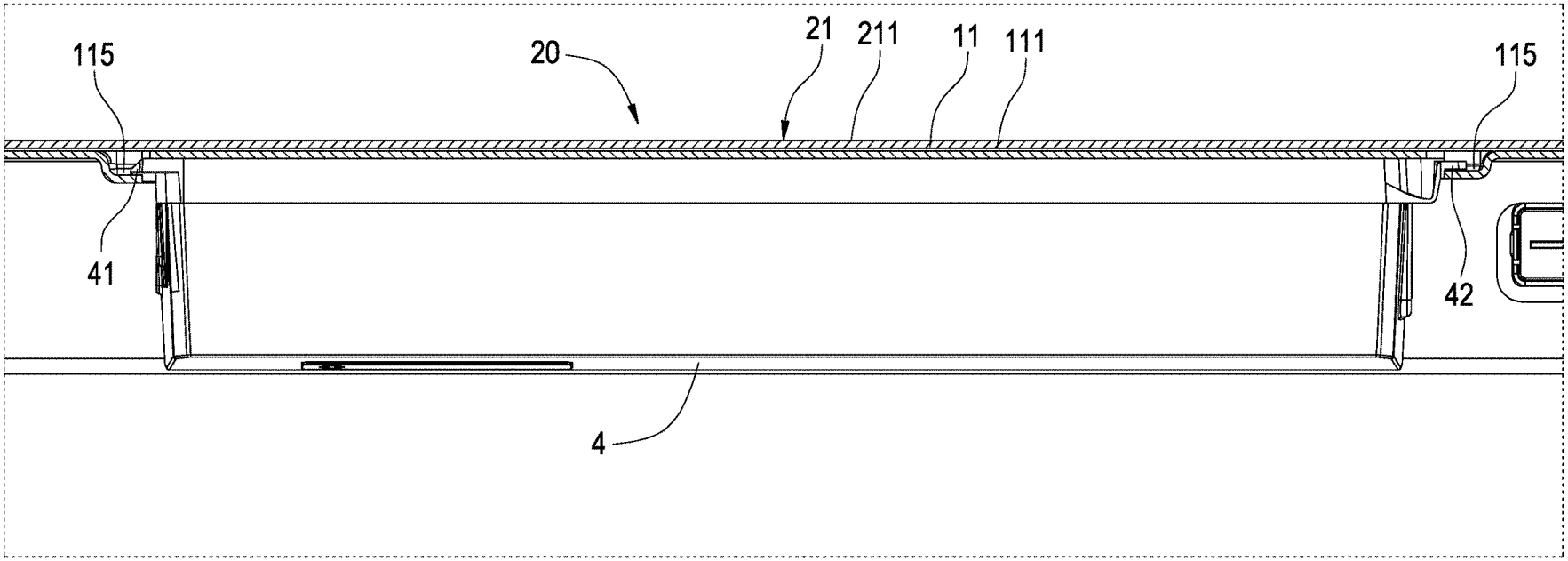
FIG. 8 is a cross-sectional view of the lightweight beam structure and the controller of the disclosure after being assembled.

Please refer to FIGS. 6-8. The leg frame of the disclosure further includes a controller 4. The controller 4 is approximately of a rectangular body, the two ends thereof are separately disposed with an inserting plate 41 and an elastic fastener 42. A middle area of the upper plate 11 is separately formed with two slots 115. The inserting plate 41 of the controller 4 is correspondingly inserted into one of the slots 115, and then the elastic fastener 42 of the controller 4 is embedded into another slot 115 by its elastic deformation to accomplish rapid assembling and removing.

In addition, the abovementioned details of the controller 4 is used only for explanation and description but not used to limit the claim scope of the disclosure. In other words, it may be adjusted and changed depending on actual using demands.

Please refer to FIG. 9. Each telescopic post 3 is connected to two ends of the lightweight beam structure 1. Each telescopic post 3 includes an electric motor 31, multiple tubes 32 and a transmission (not shown). The tubes 32 are connected with each other. One of the tubes 32 is connected to the bottom of the electric motor 31 to make each tube 32 be able to generate mutual movement by cooperation of the electric motor 31 and the transmission. Two sides of the electric motor 31 are separately formed with two threaded holes 311. Each electric motor 31 is received between two of the inner side plates 12 and between two of the intermediate plates 22. One of the electric motor 21 abuts against a surface of each protrusion 171 and is fixed by inserting a pivot 33 into the pivot hole 172 to screw the pivot 33 with one of the threaded holes 311 as shown in FIG. 6. Another electric motor 21 abuts against a surface of each protrusion 2221 and is fixed by inserting another pivot 33 into the pivot hole 2222 to screw another pivot 33 with the threaded hole 311 as shown in FIG. 6. As a result, each telescopic post 3 may be pre-assembled on the lightweight beam structure 1 to save the time and labor costs in an installing scene.

Please refer to FIG. 10. When assembling, each telescopic post 3 is upward rotated about the pivot 33 first, a fastening element 34 is inserted into the positioning portion 18 (shown in FIG. 6) and the rest of the threaded holes 311 for fixing, and another fastening element 34 is inserted into the positioning hole 2232 (shown in FIG. 6) and the rest of the threaded holes 311 for fixing. Then, the side wings 5 are separately disposed on a side of each telescopic post 3 and connected to two ends of the lightweight beam structure 1. Each side wing 5 includes an edge plate 51 and a transverse plate 52 bent and extended from the edge plate 51. The inner side of the edge plate 51 is connected with a connecting plate 53. The connecting plates 53 are correspondingly inserted into ends of the first frame 10 and the second frame 20. The edge plates 51 correspondingly cover a lateral side of the electric motor 31 and ends of the first frame 10 and the second frame 20. Each transverse plate 52 is formed with multiple locking holes 521 at intervals.

In addition, the leg frame of the disclosure further includes a pair of support feet 6. Each support foot 6 is connected with an end of each tube 32, which is away from the electric motor 31, to improve the stability of the leg frame.

Figure 11:
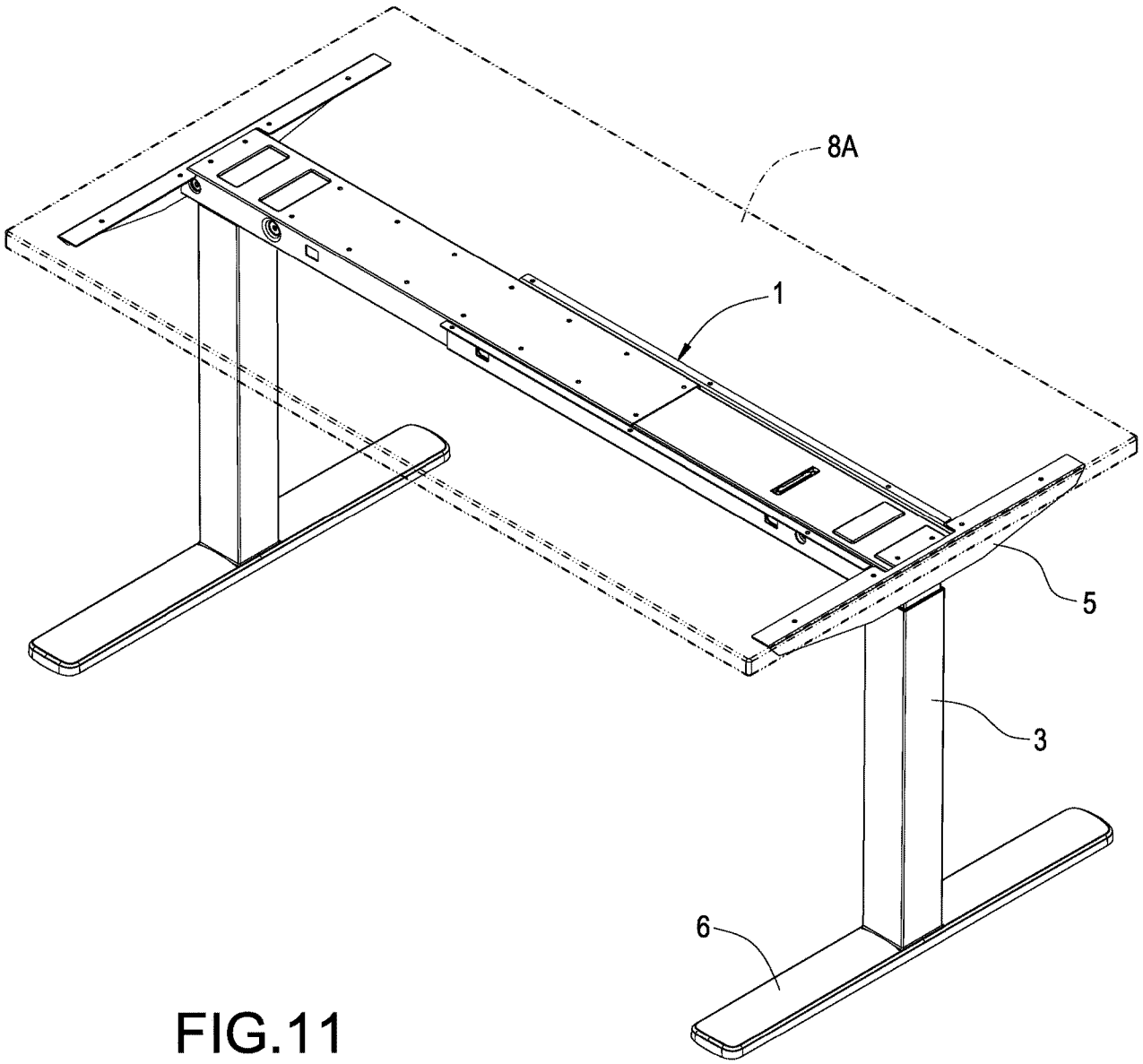
FIG. 11 is a schematic view of the leg frame of an electric table of the disclosure associated with an elongated table plate.

Please refer to FIG. 11. Apart from the above embodiment, the leg frame of the disclosure may also be implemented by another embodiment. In this embodiment, each intermediate plate 22 is slidably connected to each groove 15, the alignment hole 112 is selectively aligned with one of the locking holes 212, and a screwing element 9 is used to pass through an elongated table plate 8A for fixing as shown in FIG. 13. In other words, the leg frame of the disclosure may be applied to table plate 8, 8A having different lengths with range between about 1000 mm and about 1600 mm.

Figure 12:
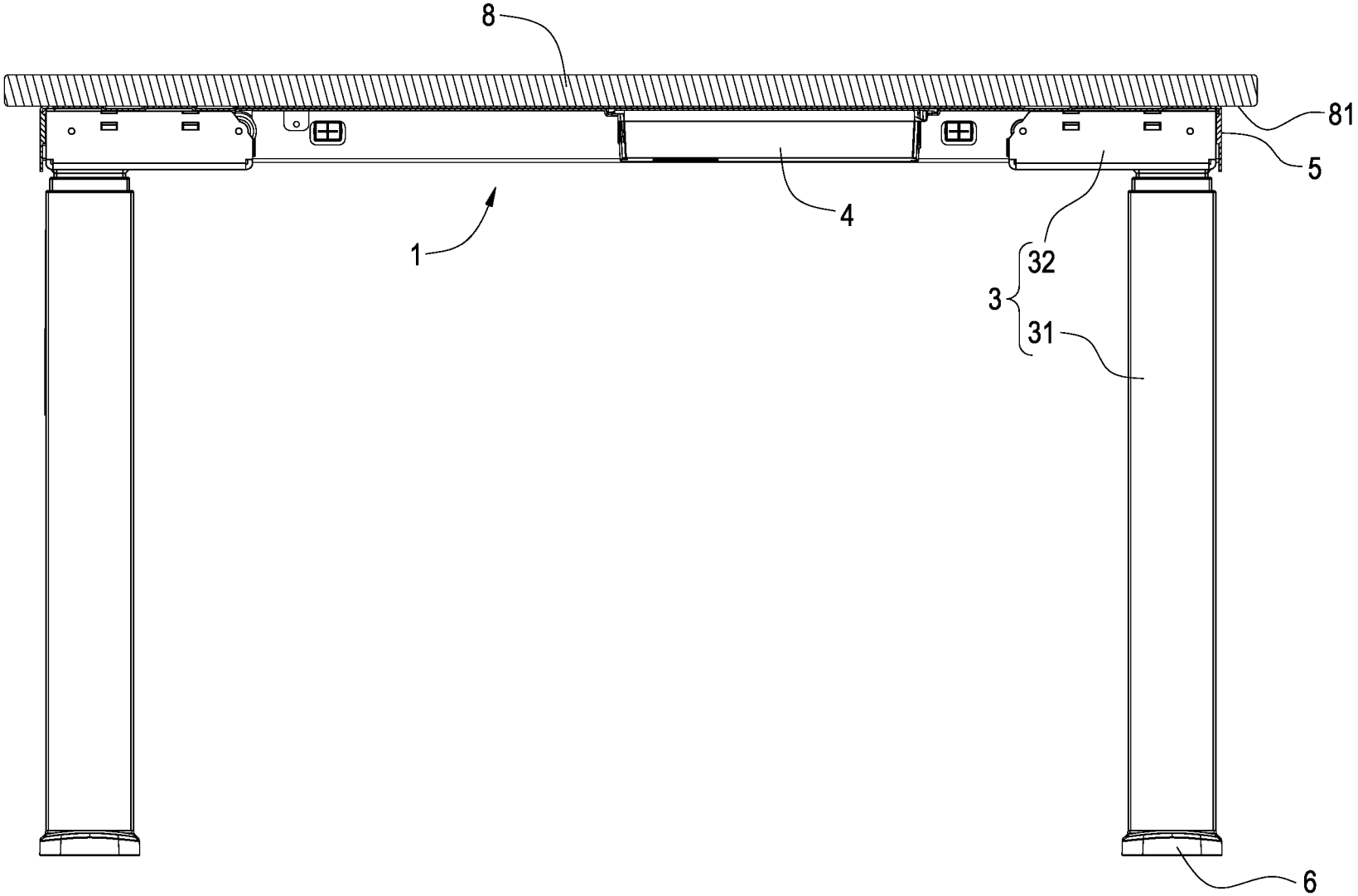
FIG. 12 is a cross-sectional view of the electric table of the disclosure.

Please refer to FIGS. 12 and 13. The disclosure further provides an electric table, which includes a leg frame of an electric table, a table plate 8, and multiple screwing elements 9. The table plate 8 has a bottom surface 81. Each screwing element 9 separately passes through the locking holes 142, 1132, 212 of the first frame 10 and the second frame 20 to attach both each fixing plate 14 and the top plate 21 on the bottom surface 81. Also, when the leg frame of the disclosure is applied to a table plate 8 with a general length, the stability of the overall structure may be further increased by embedding each plug 24 into each plugging hole 16, 221.

While this disclosure has been described by means of specific embodiments, numerous modifications and variations could be made thereto by those skilled in the art without departing from the scope and spirit of this disclosure set forth in the claims.

What is claimed is:

1. A beam structure comprising:

a first frame, comprising an upper plate, a pair of inner side plates downward bent and extended from two sides of the upper plate, a pair of outer side plates upward bent and extended from the inner side plates respectively, and a pair of fixing plates bent and extended from the outer side plates respectively, each outer side plate disposed outside each inner side plate, and a groove disposed between each inner side plate and each outer side plate; and a second frame, connected with the first frame, comprising a top plate and a pair of intermediate plates downward bent and extended from two sides of the top plate, each intermediate plate received in each groove, and the top plate disposed over the upper plate.

2. The beam structure of claim 1, wherein each intermediate plate is slidably connected to the groove.

3. The beam structure of claim 1, wherein each fixing plate, the upper plate and the top plate separately comprises multiple locking holes.

4. The beam structure of claim 1, wherein each fixing plate and the top plate respectively comprise an upper surface, and the upper surfaces are substantially on a same plane.

5. The beam structure of claim 1, wherein each fixing plate and the upper plate respectively comprise an upper surface, and the upper surfaces of the fixing plates are substantially on a same plane and on a plane higher than that of the upper surface of the upper plate.

6. The beam structure of claim 1, wherein the top plate comprises at least one recess portion, the recess portion, and the upper plate respectively comprise a lower surface, and the lower surfaces are substantially on a same plane.

7. The beam structure of claim 1, wherein the upper plate comprises at least one stage disposed on one end thereof away from the top plate, the stage and each fixing plate respectively comprise an upper surface, and the upper surfaces are substantially on a same plane.

8. The beam structure of claim 1, further comprising: a screwing element, wherein the upper plate comprises at least one alignment hole, the top plate comprises multiple locking holes, the alignment hole is selectively aligned with one of the locking holes to be positioned through the screwing element passing through the alignment hole and the locking hole.

9. The beam structure of claim 1, further comprising: multiple plugs, wherein multiple plugging holes are disposed on each inner side plate and each outer side corresponding to each other, and each plug passes through each plugging hole.

10. The beam structure of claim 1, wherein each intermediate plate comprises a back-folded plate extended from one end thereof away from the top plate, and the back-folded plate is located between the intermediate plate and the inner side plate.

11. A leg frame of an electric table, the leg frame comprising:

a beam structure comprising a first frame and a second frame, the first frame, comprising an upper plate, a pair of inner side plates downward bent and extended from two sides of the upper plate, a pair of outer side plates upward bent and extended from the inner side plates respectively, and a pair of fixing plates bent and extended from the outer side plates respectively, each outer side plate disposed outside each inner side plate, and a groove disposed between each inner side plate and each outer side plate; and the second frame, connected with the first frame, comprising a top plate and a pair of intermediate plates downward bent and extended from two sides of the top plate, each intermediate plate received in each groove, and the top plate disposed over the upper plate;

a pair of telescopic posts, separately connected to two ends of the beam structure, and each telescopic post comprising an electric motor; and a pair of side wings, each side wing disposed a side of each telescopic post.

12. The leg frame of claim 11, wherein each telescopic post is pivotally connected to the beam structure.

13. The leg frame of claim 11, further comprising: a controller, wherein the controller comprises an inserting plate and an elastic fastener disposed on two ends thereof, the upper plate comprises two slots, the inserting plate is correspondingly inserted in one of the slots, and the elastic fastener is correspondingly embedded in another one of the slots.

14. The leg frame of claim 11, further comprising: a pivot, wherein each inner side plate and each outer side plate separately comprise a pivoting portion, each pivoting portion comprises a protrusion disposed on the inner side plate and a pivot hole penetrating the protrusion and the outer side plate, and the electric motors is disposed between the protrusions and is fixed by the pivot being inserted to the pivot hole.

15. The leg frame of claim 11, further comprising: a pivot, wherein each intermediate plate comprises a pivoting portion, each pivoting portion comprises a protrusion disposed on the intermediate plate and a pivot hole penetrating the protrusion, and the electric motors is disposed between the protrusions and is fixed by the pivot being inserted to the pivot hole.

16. An electric table comprising:

a leg frame of an electric table, the leg frame comprising a beam structure, a pair of telescopic posts and a pair of side wings, the beam structure comprising a first frame and a second frame, the first frame, comprising an upper plate, a pair of inner side plates downward bent and extended from two sides of the upper plate, a pair of outer side plates upward bent and extended from the inner side plates respectively, and a pair of fixing plates bent and extended from the outer side plates respectively, each outer side plate disposed outside each inner side plate, and a groove disposed between each inner side plate and each outer side plate; and the second frame, connected with the first frame, comprising a top plate and a pair of intermediate plates downward bent and extended from two sides of the top plate, each intermediate plate received in each groove, and the top plate disposed over the upper plate;

the pair of telescopic posts, separately connected to two ends of the beam structure, and each telescopic post comprising an electric motor; and each side wing disposed a side of each telescopic post;

a table plate, comprising a bottom surface; and multiple screwing elements;

wherein each screwing element passes through the first frame and the second frame to attach each fixing plate and the top plate on the bottom surface.

* * * * *